United States Patent [19]

Fujiwara et al.

[11] 4,348,125

[45] Sep. 7, 1982

[54] PAPER GUIDE MECHANISM OF PRINTER

[75] Inventors: Toshimasa Fujiwara, Ayasemachi; Yoshiyuki Sudo, Yono, both of Japan

[73] Assignee: Copal Company Limited, Tokyo, Japan

[21] Appl. No.: 176,378

[22] Filed: Aug. 8, 1980

[30] Foreign Application Priority Data

Oct. 8, 1979 [JP] Japan ..... 54-110130[U]

[51] Int. Cl.[3] ..... B41J 15/18; B41J 15/04

[52] U.S. Cl. ..... 400/645.1; 400/606; 400/608.3; 226/196; 271/240

[58] Field of Search ..... 400/647, 647.1, 645.1, 400/616.1, 605, 606, 607, 607.1–607.3, 608, 608.1–608.4; 271/273, 238, 240, 274, 272; 226/196; 101/93.14

[56] References Cited

U.S. PATENT DOCUMENTS

| | | | |
|---|---|---|---|
| 1,174,555 | 3/1916 | Fowler | 400/645.1 |
| 3,093,066 | 6/1963 | Adler | 400/586 |
| 3,467,234 | 9/1969 | Potter et al. | 101/93.14 |
| 3,581,861 | 6/1971 | Bellis | 400/645.1 |
| 3,586,149 | 6/1971 | Miller | 400/616.1 |
| 3,730,082 | 5/1973 | Perry | 101/93.14 |
| 3,960,074 | 6/1976 | Chon | 101/93.14 |
| 4,091,912 | 5/1978 | Moss | 400/616.1 |
| 4,210,076 | 7/1980 | Yamamoto et al. | 101/93.14 |
| 4,212,552 | 7/1980 | Bemis et al. | 400/249 |
| 4,248,146 | 2/1981 | Miyasaka et al. | 101/93.14 |

FOREIGN PATENT DOCUMENTS

| | | | |
|---|---|---|---|
| 825154 | 12/1959 | United Kingdom | 400/616.1 |

*Primary Examiner*—William Pieprz

*Attorney, Agent, or Firm*—Wolder, Gross & Yavner

[57] ABSTRACT

A paper guide mechanism for use with a printer of the type, in which a rolled paper inserted into an inlet opening and introduced by a guide into a printing portion and in which the paper is guided by a guide, after it has been printed, until it is discharged from a discharge opening. A printing device has its printing mechanism assembled into a unit which is accommodated in such a movable block as is rotatable with respect to the body of the printer. Moreover, one of guide plates forming a running path for guiding the paper is fixed to the lower end of the movable block. Thus, the rolled paper being guided through the running path can be easily exposed and accessed by turning or retracting the movable block.

7 Claims, 9 Drawing Figures

PAPER GUIDE MECHANISM OF PRINTER

BACKGROUND OF THE INVENTION

1. Field of the Invention

The present invention relates to a paper guide mechanism for use with a printer and, more particularly, to a paper guide mechanism which can have its running path exposed to be accessed.

2. Description of the Prior Art

For example, in a paper guide mechanism for a printer, a space to be defined between a paper guide plate fixed to the body of the printer and a separate paper guide fixed to the printer body is used as a running path, through which the paper is fed while being guided.

The running path is characterized to have its clearance restricted because it has to guide the paper without any fail. Thus, the paper inserted into an inlet is fed through that restricted clearance and is printed by a printing mechanism until it is discharged from an outlet.

The problem encountered in this instance is that the paper to be used in the printer is of such rolled type as to have a small thickness but a large length thereby to frequently jam the running path.

When the running path gets jammed, it is the current practice that the paper left in the running path is picked out of the path by means of a pincette or the like. However, the running path is usually disposed within the printer body together with other mechanisms, thus making it difficult to prevent the running path from getting jammed. In the worst case, the removal of the jamming paper from the running path cannot be accomplished before the printer body is disassembled.

SUMMARY OF THE INVENTION

In view of the disadvantage concomitant with the prior art, therefore, it is an object of the present invention to provide such a paper guide mechanism for use with a printer as can have its running path exposed to be easily accessed so that the paper, which might otherwise jam the running path, can be removed from the outside.

According to a feature of the present invention, a printing mechanism disposed above paper guides is assembled into a block and is hingedly held in the printer body, and one of the paper guides is fixed to the bottom of the block so that the running path can be exposed to be accessed by turning the block as a whole.

BRIEF DESCRIPTION OF THE DRAWINGS

The present invention will now be described in connection with one embodiment thereof with reference to the accompanying drawings, in which.

DETAILED DESCRIPTION OF THE INVENTION

First of all, the construction of a printer which is used with a paper guide mechanism according to the present invention will be described.

Figure 1:
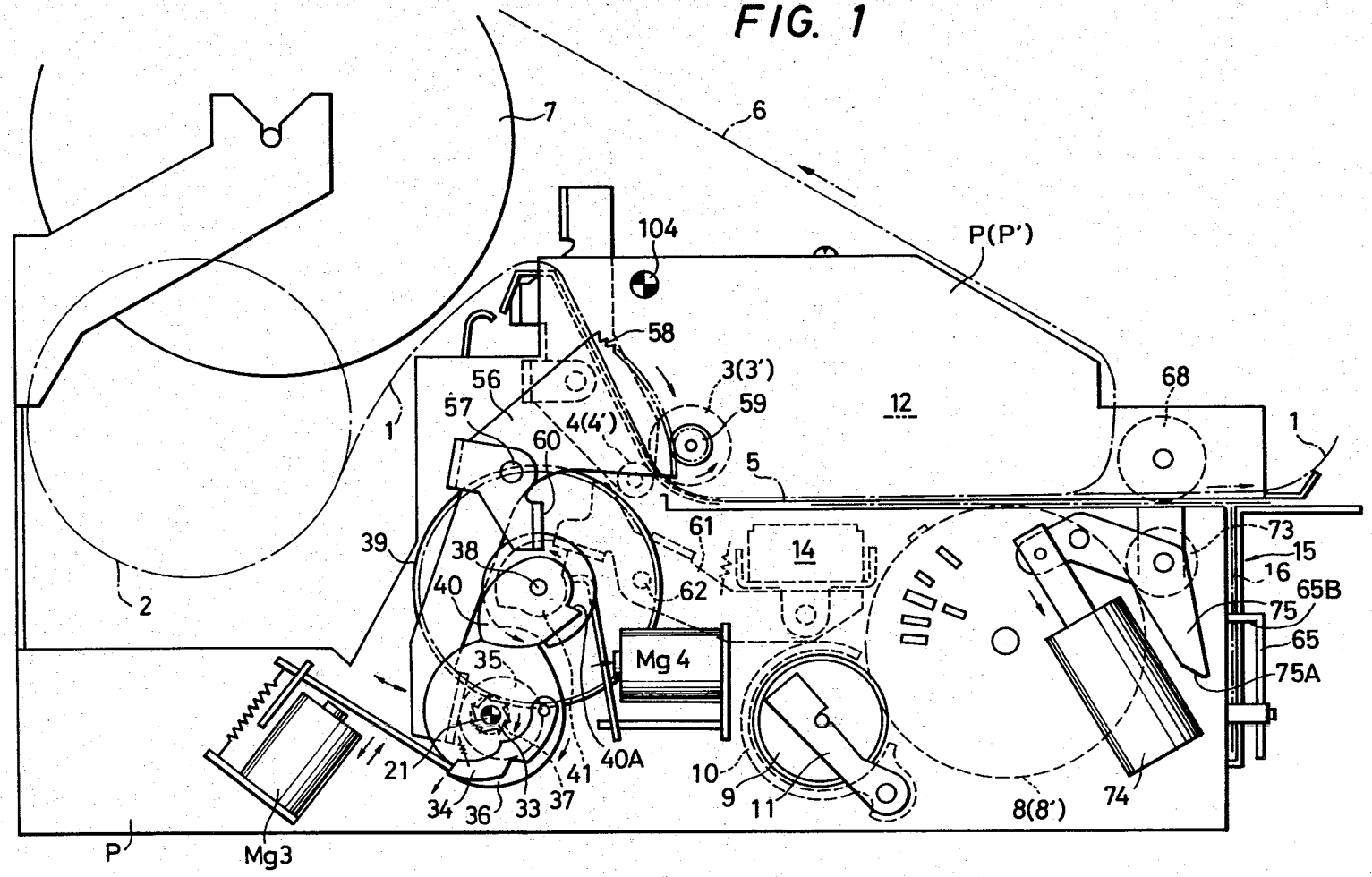
FIG. 1 is a lefthand side elevation showing a printer equipped with a paper guide mechanism according to the present invention.
Figure 2:
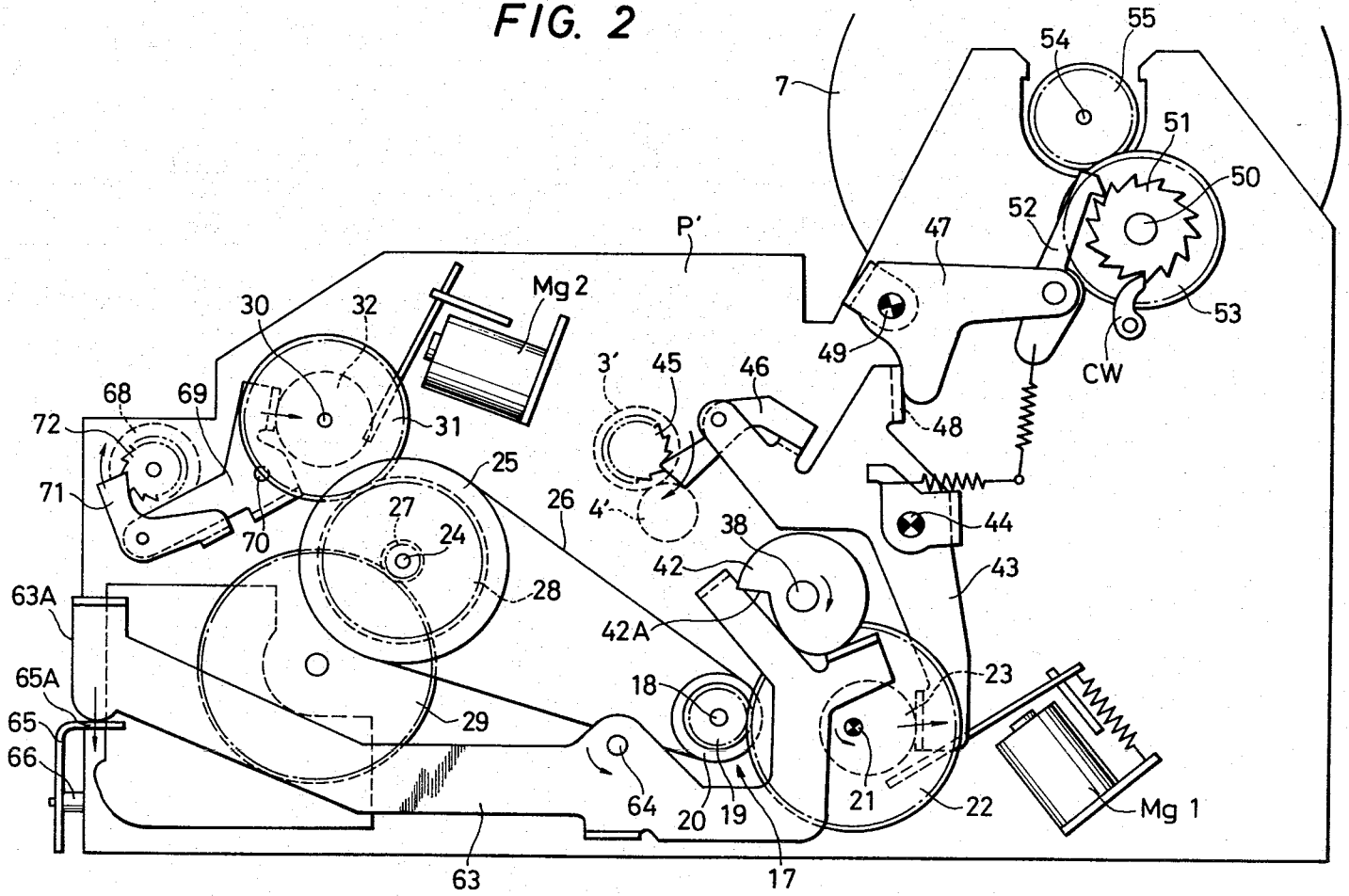
FIG. 2 is a righthand side elevation of the printer.

FIGS. 1 and 2 show the various component devices of the printer as seen from the opposite sides thereof, respectively, wherein a receipt paper 1 paid out of a supply roll 2 is guided along guide rollers and passed to and through the nip between a paper feed roller 3 and a cooperating roller 4 to a horizontal paper running path 5 on which the receipt paper 1 is transferred in a horizontal direction. Similarly, a jounal paper 6 paid out of a jounal paper supply roll (not shown) which is disposed in parallel to the supply roll 2 is passed to and through the nip between a paper feed roller 3' and a cooperating roller 4' which are similar to the paper feed roller 3 and cooperating roller 4', respectively, to the horizontal paper running path 5 on which the jounal paper 6 is transferred to the receipt paper 1 in the horizontal direction. After having passed through the horizontal paper running path 5, the jounal paper 6 is turned upwardly and rolled about a take-up roll 7. The drive mechanism for driving these paper feed rollers 3 and 3' which are adapted to transfer the receipt paper and jounal paper, respectively, will be described hereinafter.

Disposed below the horizontal paper running path 5 are a receipt paper printing drum 8 and a similar jounal paper printing drum 8' which correspond to the running paths of the receipt paper 1 and jounal paper 6, respectively. Each of these drums is formed on the peripheral surface thereof with a plurality of characters to be printed and rotatably driven in the manner as will be described hereinafter. An ink application roller 9 is disposed adjacent to the character formed peripheral surface of the associated printing drum for applying ink to the printing faces of the characters. The ink application roller 9 is rotatably received within a holder 10 and has the shaft jounalled in a support plate 11 so that the ink application roller 9 is urged to contact the peripheral surface of the associated printing drum 8.

A printing device 12 is disposed above the section of each of the receipt paper 1 and jounal paper 6 for effecting printing on the receipt paper 1 or jounal paper 6 in cooperation with the associated printing drum 8 or 8'. As well known in the art, the printing device 12 has a plurality of hammers 13 the number of which corresponds to the number of character rows to be printed on the printing drums 8 and 8', and when a desired or selected hammer 13 is actuated through the energization of an electromagnetic device Mg5 in a known manner, the hammer strikes against the printing drum 8 or 8' at a suitable time point with the receipt paper or jounal paper disposed therebetween, a desired or selected character on the printing drum is printed on the undersurface of the paper.

A stamp 14 is also disposed below the horizontal paper transfer plane 5 and is actuated by a mechanism as will be described hereinafter when a desired or predetermined printing operation has completed on the receipt paper 1, for example, to thereby stamp a suitable marking on the undersurface of the receipt paper 1.

The discharge end of the printer from which the printed receipt paper 1 is discharged is provided with a cutter device 15 which has a cutter 16 to be slidably moved upwardly and downwardly by a mechanism as will be described hereinafter to cut the printed receipt paper 1 into receipt paper sections.

The construction and operation of the printing device has been diagrammatically described hereinbefore. The following description is directed to the paper guide mechanism according to the present invention.

Figure 3:
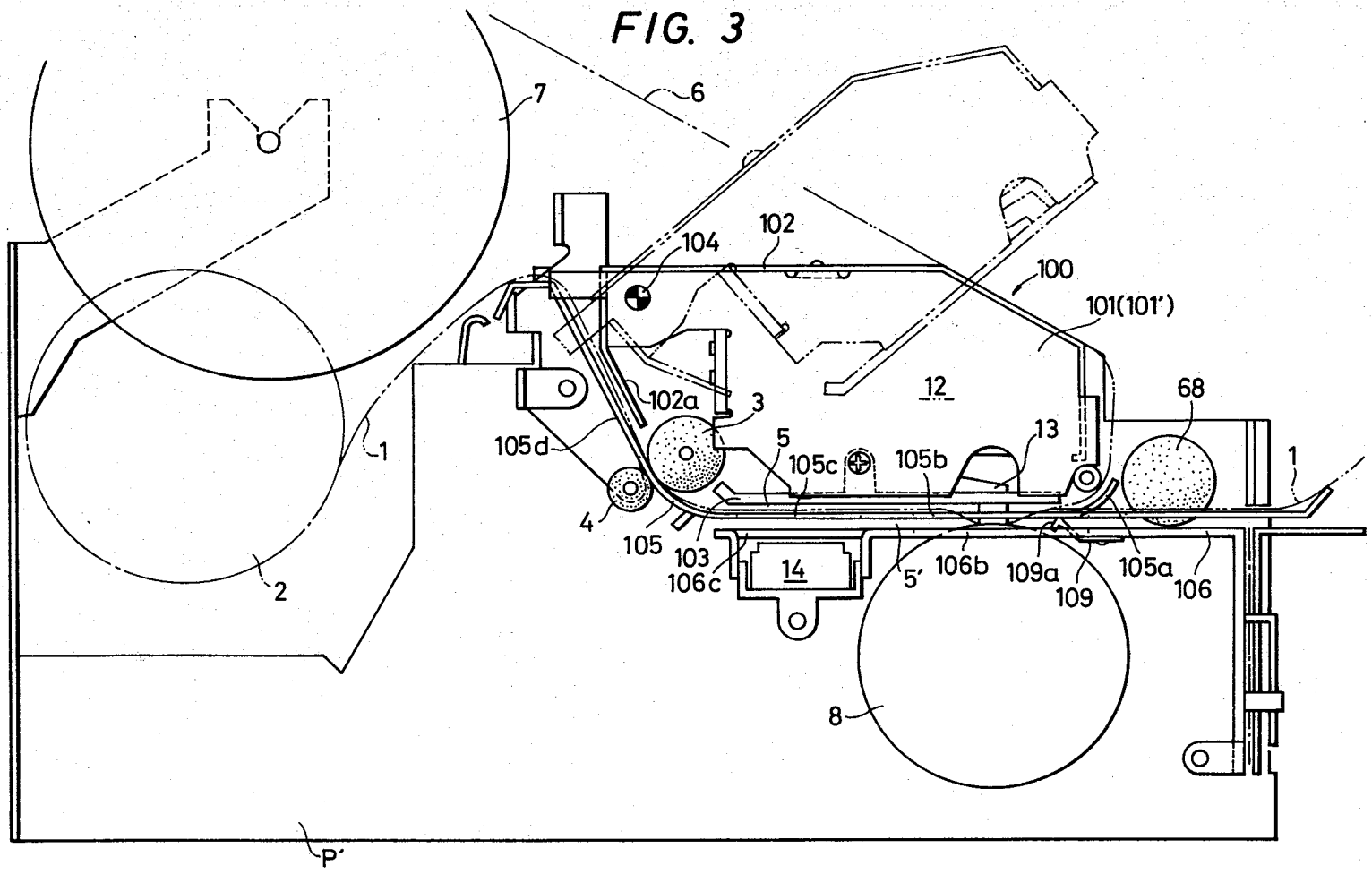
FIG. 3 is a lefthand side elevation showing the essential portion of FIG. 1 under the condition of the side plate being removed.

With reference to FIG. 3, reference numeral 100 indicates a movable block which is integrally composed of right and left side plates 101 and 101', a cover plate 102 and a paper guide upper plate 103. The movable block 100 thus composed is hingedly held between the right and left side plates P and P' of the body of the printing device by means of a shaft 104. On the other hand, the movable block 100 has accommodated therein the aforementioned printing mechanism 12 (the detail of which will be described later), whereas the cover plate 102 is formed with a paper inlet upper guide 102*a*.

When the movable block 100 is held under the condition shown in FIG. 3, the guidances of the receipt paper 1 and jounal paper 6 and the printing operations of the same by the hammers 13 are accomplished.

During the aforementioned printing operation, on the other hand, if the paper running path 5 gets jammed with the receipt paper 1 or jounal paper 6, the movable block 100 is turned as a shown about the shaft 104 into the position as shown in double-dotted lines so that the paper running path 5 can be exposed to be accessed. As a result, the jamming with the paper can be eliminated without any difficulty.

Figure 4:
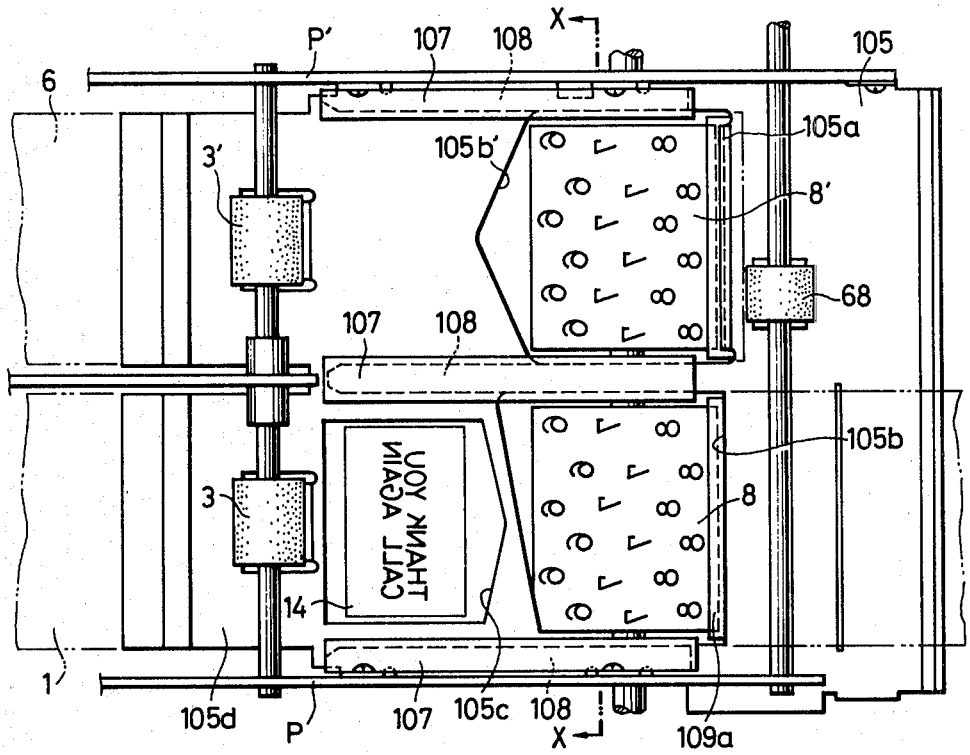
FIG. 4 is a top plan view showing the essential portion of the running path of the printer when a movable block is removed.
Figure 7:
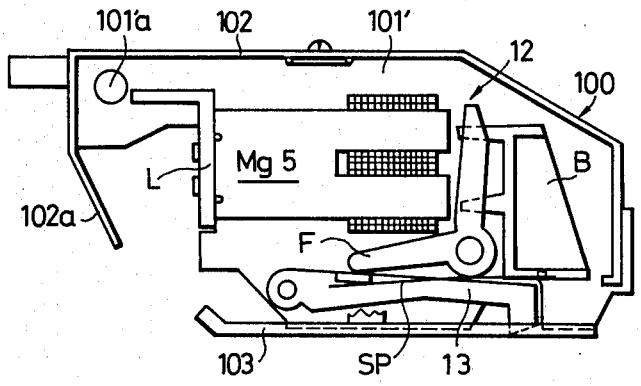
FIG. 7 is a lefthand side elevation showing the movable block with its lefthand side plate being removed.

By removing the shaft 104, moreover, the movable block 100 can also be completely taken out of the body of the printing device. FIG. 4 shows the running path which is exposed in this instance. The movable block 100 which has been completely taken out is shown in FIG. 7.

Figure 5:
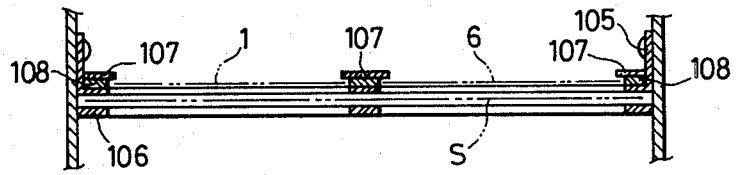
FIG. 5 is a simplified section taken along line X—X of FIG. 4.

The aforementioned horizontal paper running path 5 and 5' will now be described with reference to FIGS. 3, 4 and 5, among which FIG. 4 shows the condition having the movable block 100 removed in FIG. 3 whereas FIG. 5 is a section taken along line X—X of FIG. 4.

In these Figures, reference numeral 105 indicates a paper guide lower plate, which is provided with a U-turn guide 105*a* for the jounal paper 6, apertures 105*b* and 105*b'* for the printing drums 8 and 8', respectively, an aperture 105*c* for the stamp 14 of the receipt paper 1, and a paper inlet lower guide 105*d*. The paper guide lower plate 105 thus constructed is fixed to the aforementioned side plates P and P'. It should be noted here that the aforementioned aperture 105*b* has substantially the same width as that of the receipt paper 1 whereas the aperture 105*b'* has substantially the same width as that of the jounal paper 106.

Thus, the aforementioned paper guide upper and lower plates 103 and 105 define the horizontal paper running path 5, through which the receipt paper 1 and jounal paper 6 are guided.

Reference numeral 106 indicates a slip guide which is similarly provided with an aperture 106*b* for the printing drums 8 and 8' and an aperture 106*c* for the stamp 14. The slip guide 106 thus constructed defines the other horizontal paper running path 5' together with the aforementioned paper guide lower plate 105 so that a slip paper S may be guided.

Reference numeral 107 indicates a guide plate which is fixed together with widthwise paper guides 108 to the aforementioned paper guide lower plate 105 so that the receipt paper 1 and jounal paper 6 may be guided in the manner as shown in FIG. 5.

As a result, under the condition (as shown in FIG. 3) having the aforementioned movable block 100 assembled, the receipt paper 1 and jounal paper 6 have their center portions guided by the paper guide upper and lower plates 103 and 105 and their widthwise edges guided by said widthwise paper guides 108.

After the aforementioned movable block 100 is turned or removed in the manner as shown in double-dotted lines in FIG. 3, the guidance is effected by the aforementioned guide plate 107.

The remaining construction of the printer will now be described.

As more clearly shown in FIG. 2, the printer includes a motor 17 which has the shaft 18 on which a gear 19 and a pulley 20 are mounted. The gear 19 meshes a gear 22 mounted on a shaft 21 through a spring clutch (not shown) so that the gear 22 normally rotates freely about the associated shaft, but rotates together with the shaft 21 when a magnet MG1 is energized to thereby rotatably drive a cam 23 mounted on the shaft 21.

The pulley 20 is drivingly connected through an endless belt 26 to a pulley 25 rigid to a shaft 24 on which gears 27 and 28 are mounted. The gear 27 meshes a gear 29 mounted on the shaft on which the printing drums 8 and 8' are coaxially mounted so as to normally rotate. The gear 28 meshes a gear 31 mounted on a shaft 30 through a spring clutch (not shown). The gear 31 normally rotates freely about the shaft 30, but rotates together with the shaft 30 when a magnet Mg2 is energized so as to rotatably drive a cam 32 mounted on the shaft 30.

As more clearly shown in FIG. 1, the shaft 21 further has a ratchet wheel fixedly secured thereto and also a clutch plate 36 attached thereto and the clutch plate has a pawl 34 adapted to engage the ratchet wheel 33 and a cam 35. When a magnet Mg3 which normally restrains the pawl 34 against engagement with the ratchet wheel 33 is energized, the pawl is released from the restraning force of the magnet to be allowed to engage the ratchet wheel whereby the clutch plate 36 and cam 35 rotate together with the shaft 21. The shaft 21 further has a gear 37 fixedly secured thereto and the gear meshes a gear 39 mounted on a shaft 38 through a spring clutch (not shown). The gear 39 normally rotates freely about the shaft 38, but rotates together with the shaft 38 when a magnet Mg4 is energized to thereby rotatably drive cams 40, 41 and 42 fixedly mounted on the shaft 38 (FIG. 2).

The lever mechanism which cooperates with the above-mentioned cams 23, 32, 35, 40, 41 and 42 will be described hereinbelow.

As more clearly shown in FIG. 2, a jounal paper feed lever 43 is urged in the clockwise direction about a shaft 44 to abut at one end against the cam 23 and the other end of the lever 43 has a pawl 46 attached thereto for engaging a ratchet wheel 45 associated with the jounal paper feed roller 3' whereby each time the lever 43 rocks once, the jounal paper feed roller 3' is rotated by one pitch. The lever 43 is formed with an engaging portion 48 adapted to engage a jounal paper pick-up lever 47. The lever 47 is urged in the clockwise direction about a shaft 49 and has at the other end a pawl 52 adapted to engage a ratchet wheel 51 rigid to a shaft 50 which has a gear 53 attached thereto. The gear 53 meshes a gear 55 mounted on the shaft 54 of the jounal paper take-up roll 7 whereby each time the lever 43 rocks once, the jounal paper take-up roll 7 is rotated by one pitch. Incidentally, the relationship between the gear 53 and the ratchet wheel 51 will be described in detail with reference to FIG. 8.

Similarly, a receipt paper feed lever 56 is urged in the counter-clockwise direction about a shaft 57 as seen in FIG. 1 so as to abut at one end against the cam 35. The other end of the lever 56 is formed with a sector toothed portion 58 having the shaft 57 as its center and the sector toothed portion 58 meshes a gear 59 associated with the receipt paper feed roller 3 whereby each time the lever 56 rocks once, the receipt paper feed roller 3 is rotated by one pitch.

As shown in FIG. 1, the receipt paper feed lever 56 has an engaging edge 60 integrally formed at one end thereof to be engaged by the raised portion 40A of the cam 40 as the cam rotates. Since the moment arm from the shaft 57 when the raised portion 40A of the cam 40 engages the engaging end edge 60 of the lever 56 to push the latter is small, the rocking angle of the receipt paper feed lever 56 becomes large whereby the meshing between the sector toothed portion 58 and gear 58 augments the receipt paper feed rate per feed from one pitch to nine pitches, for example, to thereby effect a rapid receipt paper feed.

When the lever 61 associated with the stamp 14 is urged in the counter-clockwise direction about a shaft 62 as shown in FIG. 1 to abut at one end against the cam 41, each time the cam 41 rotates through one complete rotation, the lever 61 is rocked once whereby the stamp 14 printes a stamp marking on the undersurface of the receipt paper 1.

As the lever 63 associated with the cutter 16 is urged in the counter-clockwise direction about its shaft 64 as seen in FIG. 2 to abut at one end against the cam 42 and as the cam 42 rotating in the clockwise direction as seen in FIG. 2 rotates through one complete rotation, the shoulder defined by the step 42A on the cam 42 causes the lever 63 to rock in the counterclockwise direction about the shaft 64 whereupon the other end 63A of the lever 63 pushes down one end 65A of the cutter actuation lever 65 for the cutter device 15 as shown in FIG. 2 whereby the lever 65 rotates in the clockwise direction about a shaft 66 to raise the cutter 16 attached to the lever 65 to cut the receipt paper 1 into receipt paper sections. A return spring 67 is provided for returning the lever 65.

The printer further comprises a validation printing mechanism. For performing the validation printing, a slip such as a single receipt paper the form of which has been predetermined, for example, is inserted from the right as seen in FIG. 3 into the printer below the receipt paper 1 on the horizontal paper running path 5'. For transferring the slip, a slip feed roller 68 is provided adjacent to the discharge opening in the printer. The feed roller 68 is driven by a slip feed lever 69 which follows the rotation of the cam 32 as shown in FIG. 2. The slip feed lever 69 is urged in the clockwise direction about a shaft 70 as seen in FIG. 2 to abut at one end against the cam 32 and the other end of the lever 69 has a pawl 71 attached thereto for engaging a ratchet wheel 72 associated with the roller 68 whereby as the cam 32 rotates through one complete rotation, the feed roller 68 is rotatably driven by one pitch. A roller 73 is adapted to cooperate with the slip feed roller 68 when the roller feeds the slip and jounalled in a lever 75 adapted to be operated by an electromagnetic plunger 74 whereby when the plunger 74 is energized, the lever 75 is rocked in the counter-clockwise direction to cause the roller 73 to abut against the slip feed roller 68.

The leading end 75A of the lever 75 moves to a position above the other end 65B of the cutter actuation lever 65 through the energization of the plunger 74 to define an upward displacement limit of the end 65B of the lever 65. When the plunger 74 is energized when no validation printing is effected, the rocking angle of the cutter actuation lever 65 is limited whereby a perforated line is cut in the receipt paper 1.

The printing drum 8 or 8' adapted to be continuously rotated by the motor 17 has a disc for rotation therewith as well known in the art and the disc is formed with a plurality of openings in the number corresponding to the characters on the printing drum and one reset opening. An optical printing detector is formed by luminous and light receiving elements disposed adjacent to and from the opposite sides of the disc and resets the printing drum after the drum has rotated through one complete rotation to detect the printed character. A signal of the printed character detected by the detector is sent to a control device (not shown) and when the control device receives a desired character hammering signal, the control device stores the input signal therein and controls the hammer actuation at a predetermined time point to thereby effect a desired character printing by hammering.

As clear from the foregoing description on the printer having the construction and arrangement of the components, in operation, the main switch (not shown) is turned on to actuate the motor 17 whereupon the printing drums 8 and 8' are rotated. While the printing drums 8 and 8' are rotating, the optical detector continuously detects characters to be in succession positioned in the printing position. When the optical detector detects desired characters positioned in the printing position, the detector inputs desired printing commands to the control device which in turn stores the commands therein. When desired or selected characters in the character row on the printing drums associated with the receipt paper 1 and jounal paper 6 are in succession positioned in the printing position while the drums are continuously rotating, the hammers 13 of the printing devices 12 corresponding to the selected or desired characters are actuated to print the characters on the receipt paper and jounal paper, respectively, and when all the characters in a desired character row have been printed, the printing for a particular character row is completed. At the completion of the character row printing, the magnet Mg3 is momentarily energized to rotate the shaft 21 for one complete rotation whereby the cam 35 causes the lever 56 to rock once. As the lever 56 rocks, the meshing sector toothed portion 58 and gear 59 feed the receipt paper 1 by one pitch. Simultaneously, the magnet Mg1 is also momentally energized to rotate the cam 23 through one complete rotation and the rotation of the cam causes the levers 43 and 47 to rock once. As the levers 43 and 47 rock, the pawl 46 of the lever 43 engages the ratchet wheel 45 and the pawl 52 of the lever 47 engages the ratchet wheel 51, respectively, whereby the roller 3' and take-up roll 7 are rotated by one pitch, respectively. In this way, the jounal paper 6 is transferred by one pitch in synchronization with the transfer of the receipt paper 1 by one pitch. Thereafter, the above-mentioned operation procedure is repeated for a desired number of times until a desired printing is obtained.

When a programmed printing has completed, the magnet Mg4 is momentarily energized to rotate the shaft 38 and accordingly, the cams 40, 41 and 42 rigid to the shaft rotate through one complete rotation. As these cams rotate through one complete rotation, the cam 40 engages the edge 60 of the lever 56 to rock the lever 56 through a large angle to thereby feed the receipt paper 1 rapidly. Prior to the rapid feed of the receipt paper 1 by the cam 40, the cam 41 rocks the lever 61 whereby the stamp 14 effects stamping. After the rapid feed of the receipt paper 1 by the cam 40, the cam 42 rocks the cutter lever 63 once to actuate the cutter 16 to thereby effect cutting on the receipt paper 1.

When it is desired to form a perforated line on the receipt paper instead of cutting the receipt paper, the plunger 74 is energized to thereby achieve the restraining of the cutter actuation lever 65 by the lever 75.

And when it is desired to effect validation printing, the slip on which the validation printing is performed is previously set on the horizontal paper running path below the receipt paper 1 in the manner as mentioned hereinabove and the plunger 74 is energized. With the plunger 74 maintained in the energized state, the magnet Mg2 is energized to rotate the cam 32 through one complete rotation. Each time the cam 32 rotates through one complete rotation, the pawl 71 of the lever 69 engages the ratchet wheel 72 to rotate the feed roller 68 by one pitch.

The actuation of the printing device, magnets and plungers are automatically and selectively effected by commands from the control device incorporated in the printer and the control device is operated in the manner well known in the art.

Figure 6A:
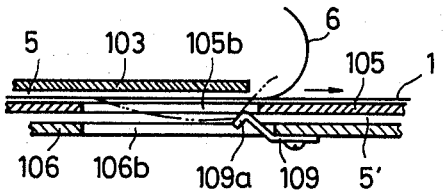
FIGS. 6(A) and 6(B) are partially sectional views illustrating the operations of the running path of FIG. 3.
Figure 6B:
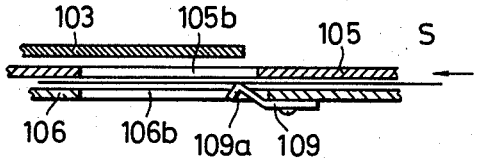

Turning now to FIGS. 3, 6(A) and 6(B), an erroneous advance preventing device for the jounal paper and receipt paper will be described hereinafter.

In these Figures, reference numeral 109 indicates an erroneous advance preventing device which is made of an elastic material and which is fixed to the aforementioned slip guide 106 while being formed at the leading end thereof with a guide portion 109*a*. Incidentally, this guide portion 109*a* protrudes into the aforementioned aperture 105*b*.

As a result, as shown in FIG. 6(A), in case the receipt paper 1 or jounal paper 6 is guided from a lefthand inlet opening to a discharge opening through the horizontal paper running path 5, its leading end is blocked by the guide portion 109*a* from erroneously advancing into the paper running path 5' for the slip, even if it is fed through the aperture 105*b* or 105*b'*, so that it can be introduced into the intrinsic correct paper running path 5.

As shown in FIG. 6(B), on the contrary, in case the slip paper S is guided from the inlet opening through the paper running path 5' into the printing position, its leading end pushes down the guide portion 109*a* so that it can continue its advance without any difficulty. Since, in this instance, the slip paper S is made wider than the aforementioned apertures 105*b* and 105*b'*, it can be prevented from erroneously advancing into the paper running path 5.

Turning now to FIG. 7, the printing mechanism 12 having accommodated therein the aforementioned movable block 100 will be described.

Incidentally, the shown movable block 100 is under the condition in which it is completely removed out of the body of the printing device and in which the side plate at this side is removed.

In this Figure, reference numeral 13 indicates the hammers whereas reference letters Mg5, F and B indicate the electromagnetic device, a ferrous member and an arranging block for said ferrous member, respectively. And, these members exist in the number equal to the characters to be printed such that the number of the hammers and the like are twelve because the characters to be printed in the present embodiment are in six units.

Incidentally, the above-mentioned hammers 13 are always biased to leftwardly rotate by a leaf spring SP so that the aforementioned ferrous member F is held under the condition apart from the aforementioned electromagnetic device Mg5.

The above-mentioned electromagnetic device Mg5 is fixedly mounted on a substrate L, which in turn is equipped with a circuit and which is fixedly secured to the side plates 101 (and 101').

With the construction thus far described, when the electromagnetic device Mg5 is energized with pulses, the ferrous member F is attracted to leftwardly rotate so that the hammers 13 are rightwardly rotated to strike against the printing drums 8 and 8'. When the printing is completed by the strikes, the hammers 13 are leftwardly rotated by the urging force of the leaf spring SP until they restore their original positions. Simultaneously with this leftward rotation, the ferrous member F is rightwardly rotated to restore its original position.

Figure 8:
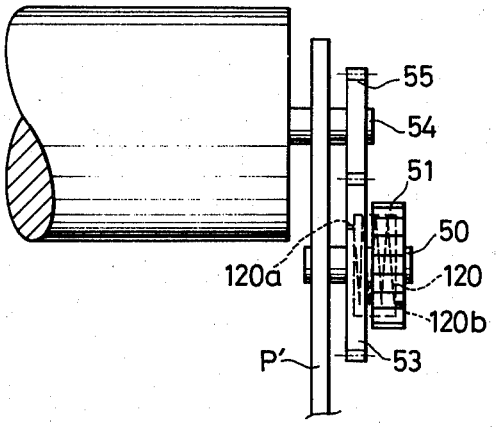
FIG. 8 is a front elevation showing the major portion of a take-up device of a jounal paper.

Turning to FIG. 8, the take-up device of the jounal paper will now be described hereinafter.

In this Figure, reference numeral 51 indicates the ratchet wheel whereas reference numerals 53 and 55 indicate the gears. The ratchet wheel 51 and the gear 53 are connected to each other by means of a coil spring 120. This coil spring 120 has its one end 120*a* attached to the gear 53 and its other end 120*b* attached to the ratchet wheel 51. Reference letters CW indicate a reverse preventing pawl.

With the construction thus far described, therefore, if the ratchet wheel 51 is leftwardly rotated by the operation of the pawl 52 as has been described with reference to FIG. 2, the gear 53 accordingly rotates leftwardly through the coil spring 120. By this leftward rotation of the gear 53, the gear 55 is rightwardly rotated to take up the jounal paper 6.

In the course of the leftward rotation of the ratchet wheel 51, however, if the take-up of the jounal paper 6 is completed so that a tension is applied to the jounal paper 6, the rotation of the gear 53 is blocked. On the contrary, the ratchet wheel 51 continues its leftward rotation until it is stopped after a preset turns of rotations.

Thus, the rotational energy is stored in the coil spring 120 by the stop of the gear 53 and by the rotation of the ratchet wheel 51. The energy thus stored effects leftward rotation of the gear 53 independently of the ratchet wheel 51, in case the jounal paper is slackened for some cause, so that the jounal paper can be taken up.

With the construction thus far described, the present invention can enjoy the advantage that the jamming with paper, if any, can be promptly coped with.

What is claimed is:

1. In a paper tape printer in which paper is drawn from a roll of paper and advanced along a feed run through a printing station:

a main body;

a first guide member including a first guide plate provided with a first opening and located in said main body and extending along and below said feed run;

a first printing section registering with said first opening:

a mount swingably supported by said main body and including a second guide member having a second plate provided with a second opening and being movable between an advanced position with said second guide plate extending along and parallel to and above and proximate said first guide plate with said second opening registering with said first opening and delineating with said first guide plate a passageway for said paper along said feed run, and a retracted position remote from said run to open said passageway and provide access to said paper along said feed run;

a second printing section supported by and movable with said mount and registering with said second opening; and transversely spaced lip members disposed above and extending along the side edges of said first guide plate and directed toward each other and overlying only the side borders of said paper extending along said passageway and positioned between said first and second guide members to releasably restrict the vertical movement of said paper side borders when said mount is in its retracted position.

2. The printer of claim 1 wherein one of said printing sections comprises a character carrying wheel and the other of said printing sections comprises an electromagnet actuated hammer mechanism.

3. The printer of claim 1 wherein said mount comprises a housing containing said second printing section and a bottom wall defining said second guide plate.

4. The printer of claim 1 further comprising a third guide plate disposed below and parallel to said first guide plate and delineating therewith a slip passageway, said third guide plate having a third opening registering with said first opening and first printing section.

5. The printer of claim 4 further comprising unidirectional blocking means extending across said slip passageway to the level of and in registry with said first opening to block the passage of said paper through said first opening into and along said slip passageway.

6. The printer of claim 5 wherein said blocking means comprises a resilient finger mounted on said third guide plate at the forward edge of said third opening and including an upwardly directed projection extending to the level of said first opening and having upwardly converging front and rear faces.

7. In a paper tape printer in which paper is drawn from a roll of paper and advanced along a feed run through a printing station:

a main body;

a first guide member including a first guide plate provided with a first opening and located in said main body and extending along and below said feed run;

a first printing section registering with said first opening;

a mount swingably supported by said main body and including a second guide member having a second guide plate provided with a second opening and being movable between an advanced position with said second guide plate extending along and parallel to and above and proximate said first guide plate with said second opening registering with said first opening and delineating with said first guide plate a passageway for said paper along said feed run, and a retracted position remote from said run to open said passageway and provide access to said paper along said feed run;

a second printing section supported by and movable with said mount and registering with said second opening;

a slip guide member located in said main body below said first guide member and delineating therewith a passageway for receiving a slip paper for movement in a direction opposed to said roll paper advance direction and along said direction, said slip guide member having an opening formed therein registering with said printing section; and an erroneous advance preventing device formed of resilient material and fixed to said slip guide member, said device being provided at a free end thereof with a guide portion which protrudes into said first opening, whereby, when the leading end of said rolled paper advances into said first opening, said device blocks the advance of said rolled paper at the guide portion thereof, whereas, when said slip paper advances in the opposite direction to have its leading end pushing said device, said device deflects to unblock the run of said slip paper.

* * * * *